US007844062B2

(12) United States Patent
Bäuml et al.

(10) Patent No.: US 7,844,062 B2
(45) Date of Patent: Nov. 30, 2010

(54) METHOD FOR THE SYNCHRONIZATION OF SIGNAL TONES AND CORRESPONDING HEARING AIDS

(75) Inventors: Robert Bäuml, Eckental (DE); Wolfgang Sörgel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1153 days.

(21) Appl. No.: 11/499,824

(22) Filed: Aug. 4, 2006

(65) Prior Publication Data

US 2007/0030988 A1 Feb. 8, 2007

(30) Foreign Application Priority Data

Aug. 4, 2005 (DE) ..... 10 2005 036 851

(51) Int. Cl.
*H04R 25/00* (2006.01)

(52) U.S. Cl. ..... 381/312; 381/315

(58) Field of Classification Search ..... 381/23.1, 381/312, 314–318, 320, 323
See application file for complete search history.

(56) References Cited

U.S. PATENT DOCUMENTS 5,991,419 A 11/1999 Brander
6,768,802 B1 * 7/2004 Baechler ..... 381/315
6,839,447 B2 1/2005 Nielsen et al.
7,580,535 B2 * 8/2009 Baechler ..... 381/312
2004/0059446 A1 3/2004 Goldberg et al.

FOREIGN PATENT DOCUMENTS

| | | | |
|---|---|---|---|
| EP | 1320213 | A1 | 6/2003 |
| EP | 1380918 | A2 | 1/2004 |
| EP | 1715723 | A2 | 10/2006 |
| WO | 0207479 | A1 | 1/2002 |
| WO | 2004110099 | A2 | 12/2004 |
| WO | 2005029761 | A1 | 3/2005 |

* cited by examiner

*Primary Examiner*—Suhan Ni

(57) ABSTRACT

The output of signal tones from hearing aids for binaural coverage is to be synchronized. To this end, it is provided that the counters of the two hearing aids are equalized by a synchronization signal. By transmitting a control signal with a count value or before a predetermined count value, the simultaneous emission of a signal tone from the two hearing aids is initiated. Alternatively, for the indirect synchronization of the counters the respective differences of the counter readings may also be stored in the individual hearing aids.

12 Claims, 1 Drawing Sheet

METHOD FOR THE SYNCHRONIZATION OF SIGNAL TONES AND CORRESPONDING HEARING AIDS

CROSS REFERENCE TO RELATED APPLICATIONS

This application claims priority of German application No. 10 2005 036 851.4 filed Aug. 4, 2005, which is incorporated by reference herein in its entirety.

FIELD OF THE INVENTION

The present invention relates to a method for the synchronization of signal tones which are output from the hearing aids in binaural hearing aid coverage. The present invention further relates to a corresponding hearing aid system for binaural coverage and/or a corresponding hearing aid.

BACKGROUND OF THE INVENTION

With binaural coverage, wirelessly connected hearing aid systems permit communication between the right and left hearing aid. Nevertheless, the conversion of wirelessly received instructions, such as for example program switching, and in particular the acoustic output, are not synchronized in the two hearing aids. A time difference becomes disturbingly noticeable with the output of beeps.

A binaural hearing system with completely synchronized microphone signal processing is known from the publication U.S. Pat. No. 6,839,447. To this end, substantially unprocessed microphone signals with high data rates are transmitted between the hearing aids. A data signal is generated and transmitted and a processed signal for the electrical or acoustic output is generated therefrom. A sequence generator is required therefor. Based upon a repetitive coding sequence, a synchronization sequence is transmitted and recovered by means of correlation. This synchronization method for the microphone signal processing of the two hearing aids is, however, very costly.

SUMMARY OF THE INVENTION

The object of the present invention is, therefore, to propose a simple synchronization of hearing aids for the signal tone output.

According to the invention, this object is achieved by a method for the synchronization of signal tones which are output by the hearing aids in binaural hearing aid coverage, by transmitting a synchronization signal from a first of the hearing aids, in which a first counter is continuously counted up or down, to a second of the hearing aids, setting a second counter, which is continuously counted up or down, in the second hearing aid to the counter reading of the first counter as a function of the synchronization signal, by taking into account a predetermined signal transit time between the two hearing aids, transmitting a control signal from the first hearing aid to the second hearing aid with a count value or before a predetermined count value, in which one respective signal tone is to be emitted from the first hearing aid and from the second hearing aid, and emitting one respective signal tone from the two hearing aids when the respective counter reaches the count value.

A corresponding hearing aid system is, moreover, provided for the binaural coverage with a first hearing aid which comprises a transmission unit for transmitting a synchronization signal and for transmitting a control signal with a count value or before a predetermined count value, in which a signal tone is to be emitted, and a first counter, which may be continuously counted up or down, a second hearing aid which comprises a second counter which may be continuously counted up or down, a receiver unit for receiving the synchronization signal from the first hearing aid and for receiving the control signal and a setting unit for setting the second counter to the counter reading of the first counter according to the synchronization signal, by taking into account a predetermined signal transit time between the two hearing aids, one respective signal tone being able to be emitted from the two hearing aids when the respective counter reaches the count value.

In an advantageous embodiment, when set, the second counter is reset to a predetermined value, as the first counter is also reset for synchronization to the predetermined value by taking into account the transit time of the synchronization signal. The advantage of resetting to a defined value, for example zero, is that with the synchronization signal no count value has to be transmitted.

The aforementioned object is further achieved by a method for the synchronization of signal tones which are output by the hearing aids in binaural hearing aid coverage, by transmitting a synchronization signal from a first of the hearing aids, in which a first counter is continuously counted up or down, together with the current counter reading of the first counter, to a second of the hearing aids, transmitting a synchronization signal from the second hearing aid, in which a second counter is continuously counted up or down, together with the current counter reading of the second counter, to the first hearing aid, receiving the counter reading of the other respective hearing aid, storing a difference value between the received counter reading and the actual counter reading in each of the hearing aids, by taking into account a predetermined signal transit time between the two hearing aids, transmitting a control signal with a count value from the first hearing aid to the second hearing aid, in which a signal tone is to be emitted from the second hearing aid, and emitting a signal tone from the second hearing aid when the second counter has reached the count value and emitting a signal tone from the first hearing aid when the first counter has reached a value which is different from the count value by the difference value.

Accordingly, a hearing aid is also provided for binaural coverage with a counter which may be continuously counted up or down, a transmission unit for transmitting a synchronization signal together with the current counter reading of the counter, a receiver unit for receiving the counter reading of a further hearing aid, a memory unit for storing a difference value between the received counter reading and the actual counter reading, by taking into account a predetermined signal transit time between the two hearing aids and a signal output unit for emitting a signal tone, when the counter has reached a predeterminable count value, a control signal with a value which is different by the difference value, being able to be transmitted from the transmission unit to the other hearing aid, so that the other hearing aid may emit a signal tone when the counter of the other hearing aid reaches the value.

In contrast to the first solution, in which a master-slave principle is followed, the hearing aids in this second solution are completely equalized with one another. Different constructions are therefore not necessary for the hearing aids.

In a particular embodiment, each counter may represent a clock and the count values may represent absolute times or time periods. Therefore, the signal tone outputs may, for example, be oriented to a specific daily rhythm.

The synchronization signals are preferably transmitted to the slave hearing aid and/or to the respective other hearing aid at regular time intervals. This is advantageous, insofar as that lower requirements have to be set for the quality of the individual counters, as they are repeatedly synchronized with one another.

BRIEF DESCRIPTION OF THE DRAWINGS

The present invention is now described in more detail with reference to the accompanying drawings, in which.

DETAILED DESCRIPTION OF THE INVENTION

Figure 1:
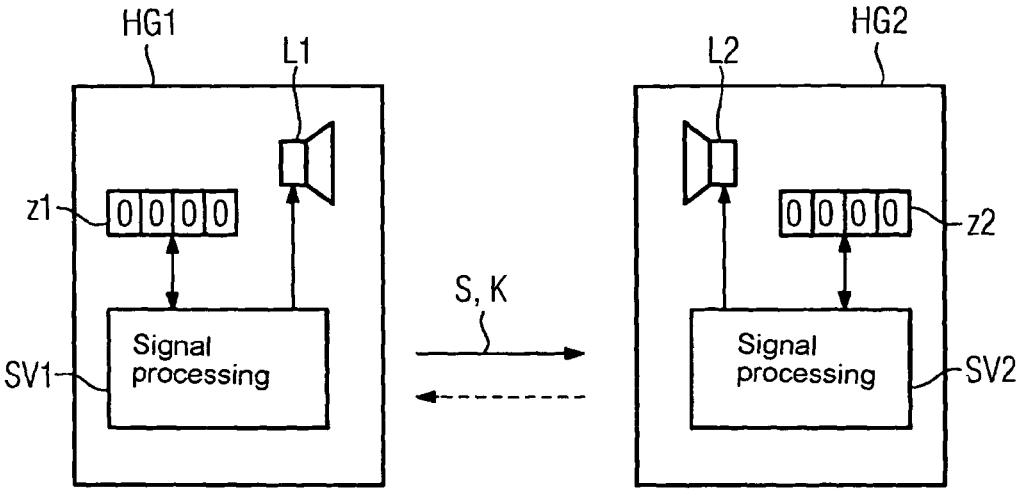
FIG. 1 is a basic circuit diagram of a hearing aid system according to the invention and FIG. 2 is a time lapse diagram for the synchronized signal output.

The embodiments described in more detail hereinafter represent preferred embodiments of the present invention.

A binaural hearing system according to the invention consists of a left hearing aid HG1 and a right hearing aid HG2. A preferably low rate data connection is created between the two hearing aids HG1 and HG2 for the transmission of control signals or synchronization signals. This data connection is sufficient for low demands and signals are exchanged only occasionally and not necessarily continuously.

The hearing aid HG1 has signal processing SV1 which, in addition to the conventional signal evaluation, serves to transmit and receive signals between the hearing aids HG1 and HG2. Moreover, it controls a loudspeaker L1, amongst others, for the output of a signal tone. Furthermore, the signal processing unit SV1 sets a counter Z1 and reads said counter.

The hearing aid HG2, together with the signal processing SV2, loudspeaker L2 and counter Z2 components, are of practically identical construction. A transmission unit may optionally be dispensed with in the hearing aid HG2, when it is used purely as a slave hearing aid.

It is an object of the invention to output signals to the right and left hearing aid at precisely the same time or with a precisely predetermined time difference. To this end, a clock is present in each hearing aid in the form of a digital counter Z1, Z2 running continuously in time.

Three exemplary embodiments are disclosed hereinafter in which the synchronization of the counters Z1 and Z2 is carried out differently.

According to a first embodiment, the hearing aid HG1 as so-called 'master', controls the communication connection between the two hearing aids. During the first synchronization after connection to the hearing aid HG2 and, moreover at certain time intervals, the hearing aid HG1 transmits a synchronization signal S corresponding to FIG. 2 to the hearing aid HG2. Due to this synchronization signal S, in both devices HG1 and HG2 the counters Z1 and Z2 are reset to their initial value and thus run synchronously. The resetting of the counter and/or the clock in the hearing aid HG1 is carried out therefore by a delay time T relative to the sending of the synchronization signal S. The delay time T is made up of the signal transit time between the two devices and the processing time of the synchronization signal S.

According to a second embodiment of the present invention the synchronization of the counters Z1 and Z2 takes place in a similar manner to the first embodiment, the synchronization signal S, however, additionally containing the absolute time/counter reading of the counter Z1. The hearing aid HG2 then sets its time and/or its counter reading to the received time/received counter reading. After the aforementioned delay time T, therefore, the two counters Z1 and Z2 now also have the same counter reading and are therefore synchronized.

According to a third embodiment, the two hearing aids HG1 and HG2 are equalized. In addition to the two counters Z1 and Z2, a storage position is present in each hearing aid for storing a digital count value. The counters are initiated independently of one another. The two devices HG1 and HG2 send synchronization signals for synchronization to the other respective device. These signals contain the respective time/counter reading of the transmitting device. The receiving device calculates from the individual time/individual counter reading at the receiving time and the received time data/count value, corrects a difference value by the delay time T and stores said difference value. Thus it is possible at any time for each device to calculate the present time/the present counter reading on the respective other device. The synchronization therefore takes place indirectly as the difference of the times/counter readings is taken into account during the signal output.

At this point it is noteworthy that the counters of the two hearing aids may have a difference, due to a clock-pulse deviation after a specific time duration. However no further details are given here.

Figure 2:
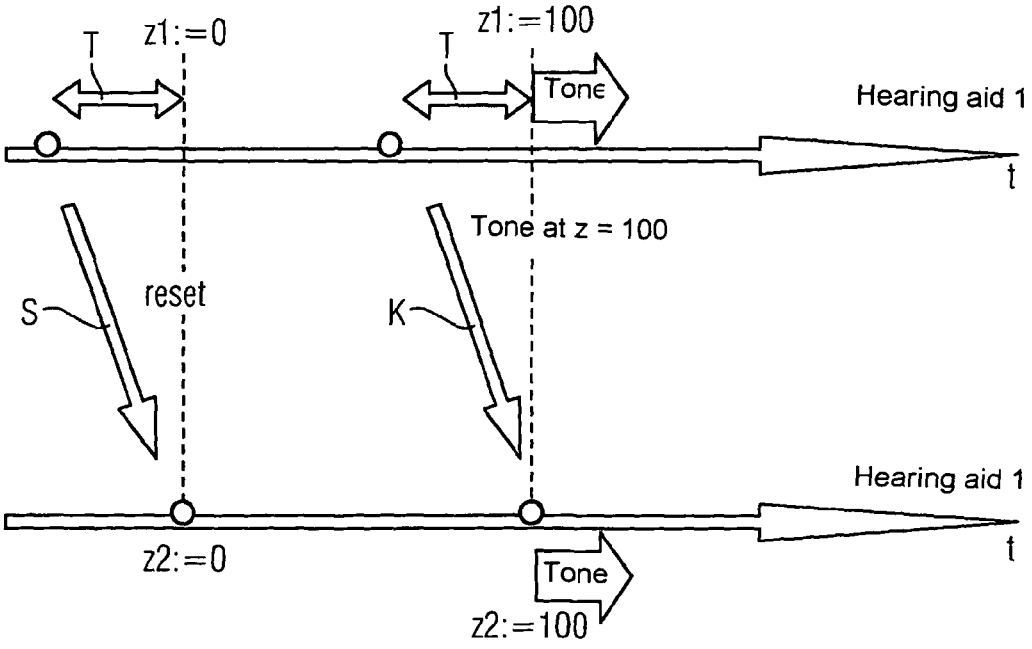

The counters Z1 and Z2 of the two hearing aids HG1 and HG2 are now synchronized according to the aforementioned embodiments. As a result, processing steps or signal outputs may now be performed simultaneously on both devices. This is carried out according to a first model by using explicit time data. To this end, for example, the hearing aid HG1 initiates an action which is to start in both hearing aids simultaneously. Together with the corresponding action command, the future absolute time data/absolute counter reading, at which the action is to start, is transmitted in a control signal K (see FIG. 2) to the hearing aid HG2. Both hearing aids HG1 and HG2 compare this time data with their current time/current counter reading and initiate the action at the given time. In the example of FIG. 2, the hearing aids are to output a signal tone at the counter reading 100. The hearing aid HG1 has to initiate this tone output at the delay time period T, at the latest, before the counter reading 100, so that the hearing aid HG2 is also able to react promptly.

According to a second model the simultaneous signal output is carried out by implicit time data. Accordingly, actions may be initiated only at specific, previously known times. The hearing aid HG1 which initiates an action, transmits the corresponding command K promptly before the next possible starting time, such that the hearing aid HG2 may receive and process this command promptly before the next starting time. The two devices then start the action at the same time as the next starting time following the sending and/or receiving of the command. This method does not require the processing time for the initialization of an action in the hearing aid HG2 to be known. Only a maximum processing time has to be able to be estimated. However, the processing time for the initialization of the counters has to be known.

According to the invention, it is therefore possible to perform processing steps and signal outputs in both hearing aids HG1 and HG2 simultaneously or at a defined time interval. This relates, for example, to the simultaneous output of control tone sequences and/or tunes in which even a smaller time difference has a greatly disruptive effect on the user. Moreover, switching processes, for example program changing, may be undertaken in a time synchronous manner which also improves the listening comfort.

By means of a specific predetermined time difference, moreover, outputs may be generated which indicate to the user a desired origin for the direction of the signal or which are specifically perceived to be alternate.

The invention claimed is:

1. A method for synchronizing a signal tone output by a plurality of hearing aids in a binaural hearing aid coverage, comprising:

providing a first counter, which is counted up or down, in a first hearing aid of a first ear;

providing a second counter, which is counted up or down, in a second hearing aid of a second ear;

transmitting a synchronization signal, which includes a counter reading of the first counter, from the first hearing aid to the second hearing aid;

setting the second counter to the counter reading of the first counter according to the synchronization signal by considering a synchronization signal transit time between the two hearing aids;

transmitting a control signal from the first hearing aid to the second hearing aid, such that the control signal includes a count value or such that the count value is predetermined and the control signal is transmitted before the count value; and emitting the signal tone from the first and second hearing aid when the respective counter reaches the count value.

2. The method as claimed in claim 1, wherein the second counter is reset to a predetermined value when switched on and the first counter is reset according for synchronization by considering the synchronization signal transit time.

3. The method as claimed in claim 1, wherein the first counter and the second counter are each a clock and the count value is a time or a time period.

4. The method as claimed in claim 1, wherein the synchronization signal is transmitted at a regular time interval.

5. A hearing aid system for binaural coverage, comprising:

a first hearing aid comprising:

a counter, which is counted up or down, a synchronization signal, which includes a reading of the counter, a control signal, and a transmission unit for transmitting the synchronization signal and the control signal; and a second hearing aid, comprising:

a receiver unit for receiving the synchronization signal and the control signal;

a counter, which is counted up or down;

a setting unit for setting the second counter to a counter reading in the received synchronization signal while considering a predetermined signal transit time between the first and second hearing aids; and an emitting unit for emitting a signal tone from the first and second hearing aids when the first or second counter reaches a count value.

6. The method as claimed in claim 5, wherein the counter of each of the two hearing aids is a clock and the count value is a time or a time period.

7. The method as claimed in claim 5, wherein the synchronization signal is transmitted at a regular time interval.

8. The method as claimed in claim 5, wherein the count value is predetermined.

9. The method as claimed in claim 5, wherein the count value is transmitted from the first hearing aid to the second hearing aid via the control signal.

10. A method for synchronizing a signal tone output by a plurality of hearing aids in a binaural hearing aid coverage, comprising:

by each of the two hearing aids:

providing a counter, which is counted up or down, in the respective hearing aid;

transmitting a synchronization signal from the respective hearing aid to the other of the two hearing aids, the synchronization signal including a reading of the counter;

receiving, by the respective hearing aid, the synchronization signal sent from the other of the two hearing aids;

setting the second counter to a counter reading of the first counter according to the synchronization signal by considering a synchronization signal transit time between the two hearing aids;

storing a difference between the reading of the counter in the received synchronization signal and a reading of the counter in the respective hearing aid while considering a signal transit time between the two hearing aids;

by a first of the two hearing aids:

emitting a signal tone when the counter of the respective hearing aid has reached a count value; and by a second of the tow hearing aids:

emitting a signal tone when the counter of the respective hearing aid has reached a value which is different from the count value by the stored difference.

11. The method as claimed in claim 10, wherein the counter of each of the two hearing aids is a clock and the count value is a time or a time period.

12. The method as claimed in claim 10, wherein each synchronization signal is transmitted at a regular time interval.

* * * * *